US008829883B2

(12) United States Patent
Samid

(10) Patent No.: US 8,829,883 B2
(45) Date of Patent: Sep. 9, 2014

(54) LEAKAGE-CURRENT COMPENSATION FOR A VOLTAGE REGULATOR

(75) Inventor: Lourans Samid, Heilbronn (DE)

(73) Assignee: Atmel Corporation, San Jose, CA (US)

( * ) Notice: Subject to any disclaimer, the term of this patent is extended or adjusted under 35 U.S.C. 154(b) by 372 days.

(21) Appl. No.: 13/228,972

(22) Filed: Sep. 9, 2011

(65) Prior Publication Data

US 2013/0063103 A1 Mar. 14, 2013

(51) Int. Cl.
*G05F 3/16* (2006.01)
*G05F 1/56* (2006.01)

(52) U.S. Cl.
CPC ..... *G05F 1/56* (2013.01)
USPC ..... 323/315; 323/313; 323/316

(58) Field of Classification Search
USPC ..... 323/312, 313, 314, 315
See application file for complete search history.

(56) References Cited

U.S. PATENT DOCUMENTS

| | | | | |
|---|---|---|---|---|
| 7,295,038 | B2 * | 11/2007 | Seo | 326/81 |
| 7,688,113 | B2 * | 3/2010 | Nascimento et al. | 326/82 |
| 8,149,056 | B2 * | 4/2012 | Pontarollo et al. | 330/264 |
| 2006/0113972 | A1 * | 6/2006 | Mihara | 323/273 |
| 2012/0119724 | A1 * | 5/2012 | Kikuchi | 323/313 |

* cited by examiner

*Primary Examiner* — Jue Zhang
*Assistant Examiner* — Lakaisha Jackson
(74) *Attorney, Agent, or Firm* — Baker Botts LLP

(57) ABSTRACT

In one embodiment, a method includes generating a drive current. Generation of the drive current results in a first leakage current, and the drive current and first leakage current each flow into a first node. The method also includes generating a second leakage current and amplifying the second leakage current to generate a leakage-compensation current. The leakage-compensation current flows away from the first node.

17 Claims, 3 Drawing Sheets

LEAKAGE-CURRENT COMPENSATION FOR A VOLTAGE REGULATOR

TECHNICAL FIELD

This disclosure generally relates to voltage regulation.

BACKGROUND

A voltage regulator may be used to supply an output voltage that is generally constant over varying conditions. For example, a voltage regulator may provide a generally constant output voltage despite changes in a load coupled to the voltage regulator or a temperature of the voltage regulator. Some voltage regulators may accomplish this by utilizing a feedback loop. Voltage regulators may be implemented with various electrical or electromechanical components, such as transistors. Voltage regulators may be used in a variety of applications, such as automobiles, computers, power generators, and power-delivery circuits.

DESCRIPTION OF EXAMPLE EMBODIMENTS

Figure 1:
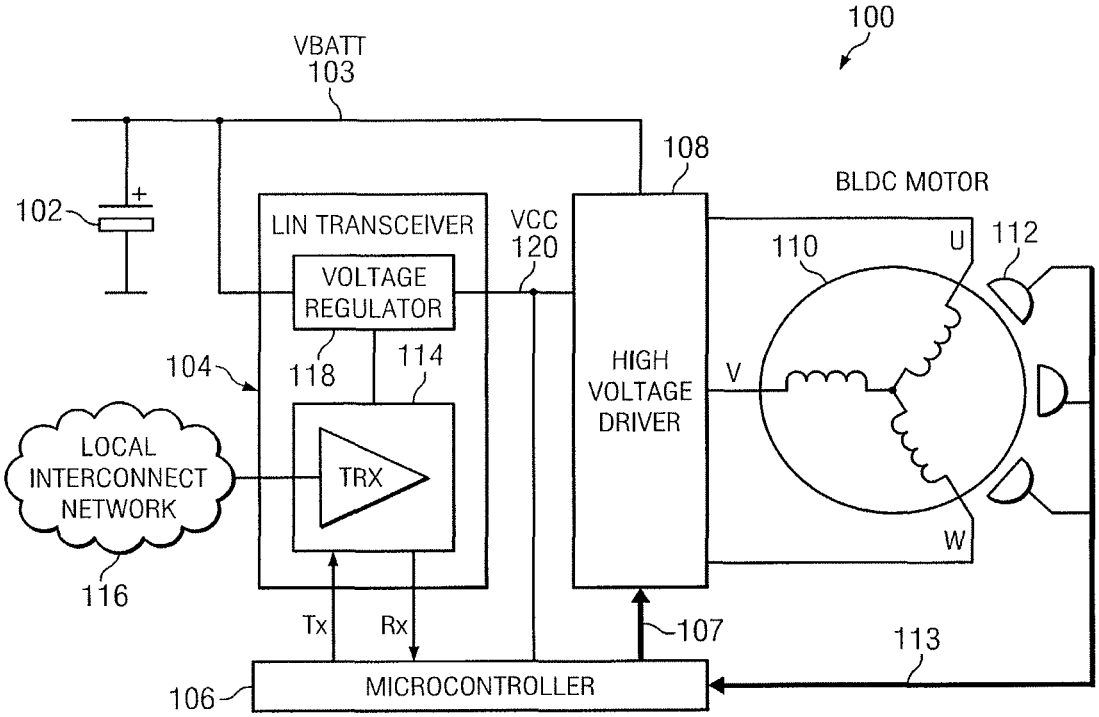
FIG. 1 illustrates an example system utilizing a voltage regulator to provide a voltage to example components.

FIG. 1 illustrates an example system 100 utilizing a voltage regulator 118 to provide a voltage VCC 120 to example components of, for example, an automobile. In the example of FIG. 1, system 100 includes battery 102, local interconnect network (LIN) transceiver 104, LIN 116, microcontroller 106, high voltage driver 108, brushless direct current (BLDC) motor 110, and sensors 112 coupled as shown. Battery 102 may be a direct current (DC) voltage source. Battery 102 may provide power to various components of an automobile. Battery 102 may supply voltage VBATT 103 to LIN transceiver 104 and high voltage driver 108. Because battery 102 may provide power to multiple components, the level of VBATT 103 may vary over time according to which components are drawing power from battery 102.

Particular components of the automobile may require a voltage level that is different from the voltage level of VBATT 103 or a more consistent level of voltage than that provided by battery 102. Accordingly, system 100 may include a voltage regulator 118 to facilitate the supply of a generally constant voltage VCC 120 to one or more components. In the example of FIG. 1, voltage regulator 118 resides within LIN transceiver 104. Although this disclosure describes and illustrates a particular voltage regulator in a particular location in a particular system, this disclosure contemplates any suitable voltage regulator in any suitable location of any suitable system. Voltage regulator 118 may provide VCC 120 to high voltage driver 108, microcontroller 106, and transceiver 114 of LIN transceiver 104. Although this disclosure contemplates voltage regulator 118 providing a particular voltage to particular components, this disclosure contemplates voltage regulator 118 providing any suitable voltage to any suitable components. In particular embodiments, voltage regulator 118 may include a leakage-current compensation circuit, as described below.

LIN 116 may be a computer-networking bus-system that may facilitate the integration of various sensor devices or actuators in an automobile. LIN 116 may be a broadcast serial network with a master that communicates with a plurality of slaves. LIN transceiver 104 is an example of a slave that LIN 16 may communicate with. LIN 116 may be coupled to other LINs or other communication buses, such as for example a controller area network (CAN).

In the example of FIG. 1, LIN transceiver 104 includes transceiver 114. Transceiver 114 may communicate with LIN 116 and microcontroller 106. For example, transceiver 114 may relay data or control signals between LIN 116 and microcontroller 106. In particular embodiments, transceiver 114 may translate data received from LIN 116 into a format suitable for microcontroller 106. Similarly, transceiver 114 may translate data received from microcontroller 106 into a format suitable for LIN 116.

In the example of FIG. 1, microcontroller 106 is coupled to LIN transceiver 104 and may communicate with LIN 116 through LIN transceiver 104. Microcontroller 106 may also communicate with high-voltage driver 108 via connection 107 and receive information from sensors 112 via connection 113. Microcontroller 106 may control various operations of high-voltage driver 108 or BLDC motor 110. In particular embodiments, microcontroller 106 may send various control signals to high-voltage driver 108 in response to feedback received from sensors 112. Microcontroller 106 may be one or more integrated circuits (ICs), such as for example general-purpose microprocessors, microcontrollers, programmable logic devices or arrays, application-specific ICs (ASICs), where appropriate.

BLDC motor 110 may include a rotor and a stator, with one or multiple permanent magnets forming the rotor and electromagnets forming the stator. The electromagnets in the stator may be coils of wire. High-voltage driver 108, together with microcontroller 106, may electronically commutate current driven through the coils to control the position or orientation of the rotor. BLDC motor 110 may be positioned near sensors 112. In particular embodiments, sensors 112 may be Hall effect sensors that each comprise a transducer that varies its output voltage in response to a magnetic field of the BLDC motor. Sensors 112 may provide feedback to microcontroller 106 regarding the operation of BLDC motor 110.

Figure 2:
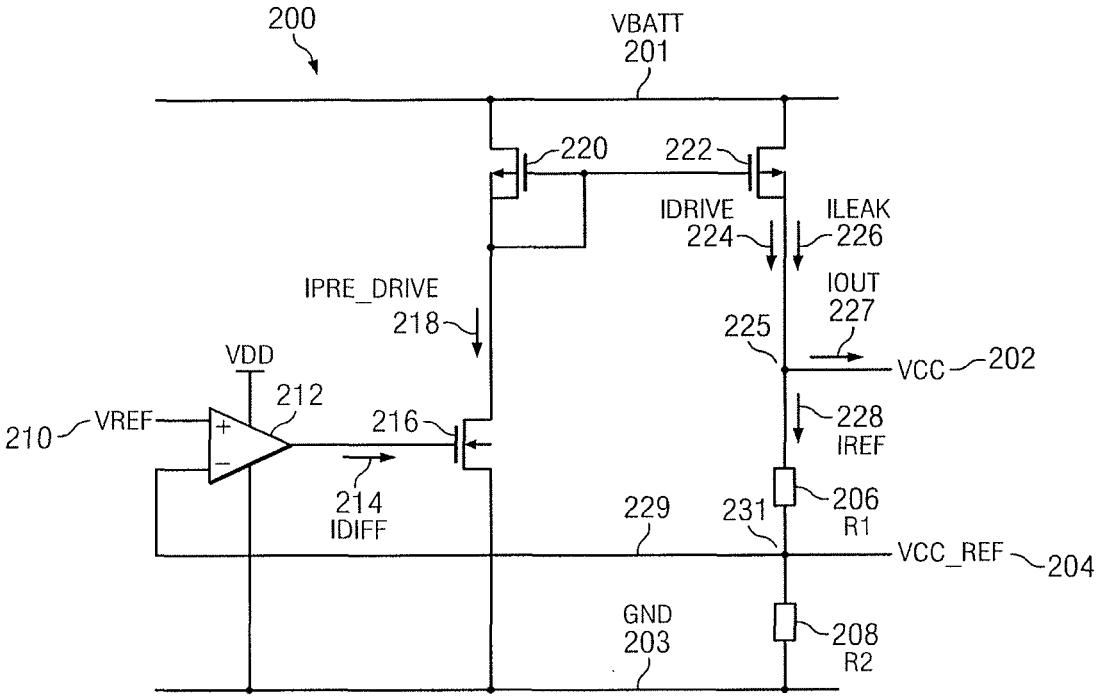
FIG. 2 (PRIOR ART)
FIG. 2 illustrates an example voltage regulator.

FIG. 2 illustrates an example voltage regulator 200. Voltage regulator 200, VBATT 201, and VCC 202 may (but need not necessarily) respectively correspond to voltage regulator 118, VBATT 103, and VCC 120 of FIG. 1. In the example of FIG. 2, voltage regulator 200 includes a differential amplifier 212, transistors 216, 220, and 222, resistors 206 and 208, and feedback path 229. Differential amplifier 212 may be coupled to an input reference voltage VREF 210 and an output reference voltage VCC_REF 204. Differential amplifier 212 produces a current IDIFF 214 that flows to the gate of an n-type metal oxide semiconductor field-effect transistor (MOSFET) 216. Transistor 216 is coupled to a current mirror comprising two p-type MOSFETs 220 and 222. The current mirror may amplify current IPRE_DRIVE 218 based on the aspect ratios of transistors 220 and 222 to produce a drive current IDRIVE 224. In particular embodiments, an aspect ratio of a transistor is a width of the transistor divided by a length of the transistor. In particular embodiments, the aspect ratio of transistor 222 may be many times the aspect ratio of transistor 220. In a particular embodiment, the aspect ratio of transistor 222 is approximately one hundred times the aspect ratio of transistor 220. In such an embodiment, the size of IDRIVE 224 may be approximately one hundred times the size of IPRE_DRIVE. A portion of IDRIVE 224 flows through resistors R1 206 and R2 208 (as a portion of IREF 228) and another portion flows to one or more circuits coupled to voltage regulator 200 (as a portion of IOUT 227). Voltage regulator 200 also includes a feedback loop 229 between node 231 and the inverting input of the differential amplifier 212.

Voltage regulator 200 may provide a supply voltage VCC 202 to one or more circuits. Under normal operation, VCC 202 may maintain a generally steady level of voltage, e.g., the voltage level of VCC 202 may deviate very little from a particular voltage level and be approximately constant over time. The level of VCC 202 may be directly related to the level of VCC_REF 204. In normal operation, feedback via feedback loop 229 may result in VCC_REF 204 tracking VREF 210 and the level of VCC_REF may be approximately equal to VREF. In particular embodiments, VREF 210 may be a very stable voltage reference, such as a bandgap voltage reference. Accordingly, in normal operation, VCC_REF 204 and VCC 202 may also be generally steady voltages, since VCC_REF tracks VREF 210 and VCC is directly proportionate to VCC_REF. The voltage level of VCC 202 may be determined by the level of VCC_REF 204 and the values of the two resistors 206 and 208 according to the following equation: VCC=VCC_REF*(1+R1/R2).

The feedback that holds VCC 202 generally constant may occur as follows. Differential amplifier 212 may compare the voltage level of VCC_REF 204 with the voltage level of VREF 210. Differential amplifier 212 may produce current IDIFF 216 based on the difference between the levels of VREF 210 and VCC_REF 204. If VCC_REF 204 rises higher than VREF 210, differential amplifier 212 may decrease the current IDIFF 214. This may decrease the currents IPRE_DRIVE 218 and IDRIVE 224 (which may be a scaled amount of IPRE_DRIVE). This may result in a drop in current IREF 228 and a lower value of VCC_REF 204 and VCC 202. Similarly, if VCC_REF 204 drops below VREF 210, differential amplifier 212 may increase the current IDIFF 214, effecting a rise in VCC_REF 204 and VCC 202.

In some situations, transistor 222 may also generate leakage current ILEAK 226. The amount of leakage current may depend on various factors, including, for example, the dimensions of transistor 222, one or more voltages applied to transistor 222, and the temperature of transistor 222. Leakage current ILEAK 226 may be substantial at high temperatures or high levels of supply voltage VBATT 201. As described above, voltage regulator 200 may be implemented in an automobile. In particular embodiments, voltage regulator 200 may be positioned in a portion of a car that is susceptible to high temperatures (such as a roof or engine compartment) and transistor 222 may thus generate an amount of leakage current ILEAK 226 that detrimentally affects voltage regulator 200 and circuits coupled to voltage regulator 200. For example, leakage current ILEAK 226 generated by transistor 222 may combine with IDRIVE 224 to increase both IOUT 227 and IREF 228. The increase in IREF may lead to an increase in VCC 202 and VCC_REF 204. If the leakage current ILEAK 226 is great enough, the voltage regulator 200 may be unable to pull VCC_REF 204 down to VREF 210, and thus VCC 202 may not track a scaled amount of VREF, but be dependent on the size of ILEAK 226. This may be detrimental, since the voltage VCC 202 may no longer be generally constant and may be at a level that is excessive for other circuits coupled to node 225.

Figure 3:
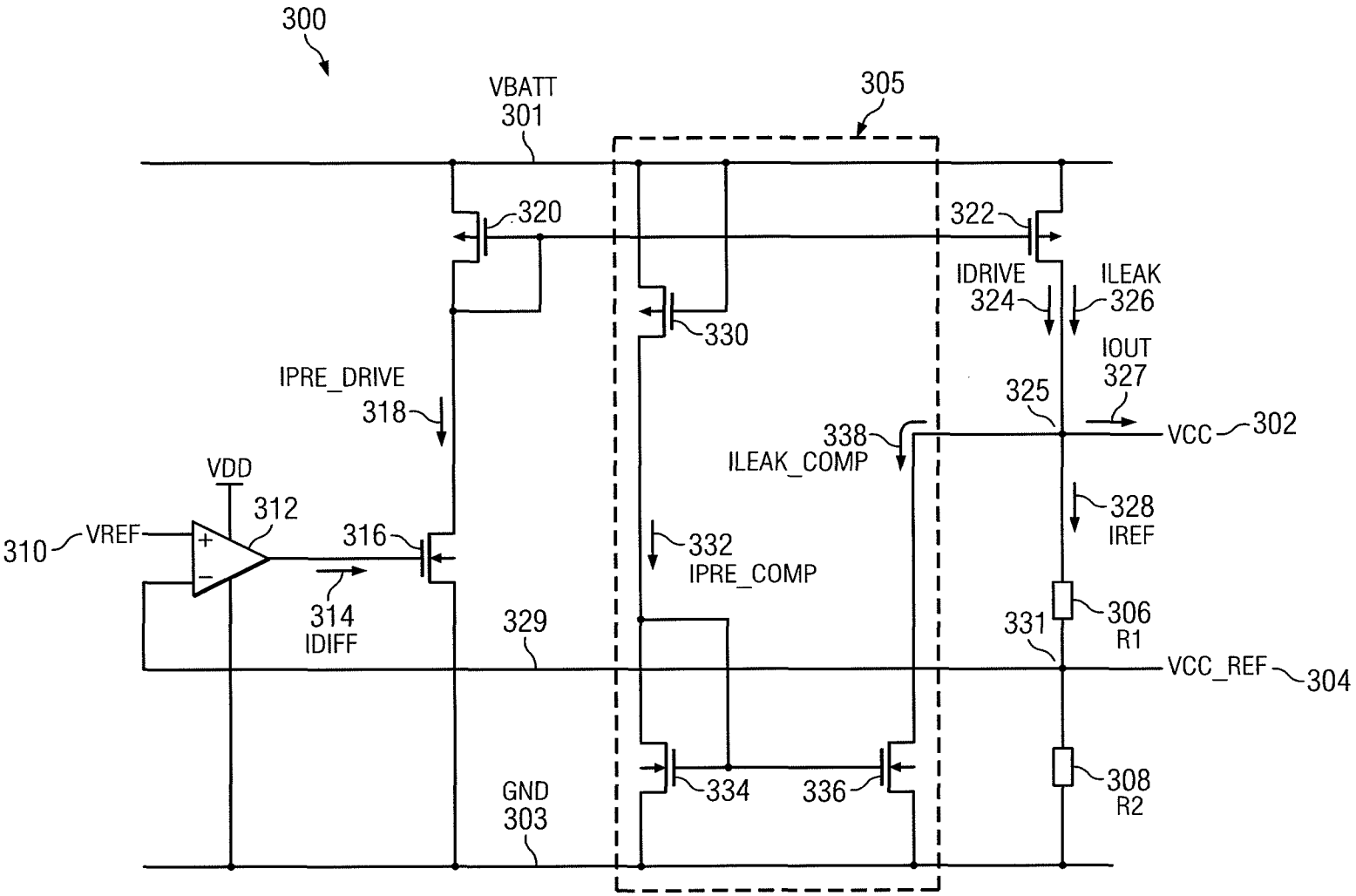
FIG. 3 illustrates an example voltage regulator with an example leakage-current compensation circuit.

FIG. 3 illustrates an example voltage regulator 300 with an example leakage-current compensation circuit 305. Voltage regulator 300, VBATT 301, and VCC 302 may (but need not necessarily) respectively correspond to voltage regulator 118, VBATT 103, and VCC 120 of FIG. 1. Voltage regulator 300 may include a differential amplifier 310; transistors 316, 320, 322, 330, 334, and 336; resistors 306 and 308; and feedback path 329. In the example of FIG. 3, voltage regulator 300 may be similar voltage regulator 200, but include leakage-current compensation circuit 305 coupled to VBATT 301, GND 303, and node 325.

Leakage-compensation circuit 305 may include a p-type MOSFET 330 and a current mirror comprising two n-type MOSFETs 334 and 336. Because the gate and source of transistor 330 are coupled to VBATT 301, MOSFET 330 operates in the cutoff mode and any current generated (IPRE_COMP 332) by MOSFET 330 is dominated by a leakage-current component. The amount of leakage current generated by transistor 330 may depend on the same factors described above, including the dimensions of transistor 330, one or more voltages applied to transistor 330, and the temperature of transistor 330. In particular embodiments, transistor 330 may located near transistor 322 and both transistors 330 and 322 may be exposed to similar external temperatures.

The current mirror including transistors 334 and 336 may amplify current IPRE_COMP 332 based on the relative aspect ratios of transistors 334 and 336 to produce a leakage-compensation current ILEAK_COMP 338 that flows away from node 325. This may reduce the amount of currents IREF 328 and IOUT 327 as current generated by transistor 322 is diverted through transistor 336. In particular embodiments, the sizes of transistors 330, 334, and 336 are configured so that the size of ILEAK_COMP 338 is approximately equivalent to the size of ILEAK 326. For example, transistor 330 may have an aspect ratio that is approximately equivalent to the aspect ratio of transistor 320 and the aspect ratio of transistor 336 divided by the aspect ratio of transistor 334 may be roughly equivalent to the aspect ratio of transistor 322 divided by the aspect ratio of transistor 320. In such an embodiment, ILEAK 326 and ILEAK_COMP 338 may be approximately equivalent to each other and the effect of ILEAK 326 on the feedback network and other circuits coupled to node 325 may be substantially canceled out by ILEAK_COMP 338. Accordingly, voltage regulator 300 may operate in a manner similar to the normal operation of voltage regulator 200 described above.

Particular embodiments may provide one or more or none of the following technical advantages. Particular embodiments may provide a leakage-current compensation circuit that generates a leakage-compensation current that compensates for a leakage current of a circuit of a voltage regulator that produces a drive current. In particular embodiments, the leakage-current compensation circuit may draw a leakage-compensation current that is approximately equal to the leakage current of the circuit producing the drive current. Accordingly, in particular embodiments, the leakage-current compensation circuit need not generate an appreciable amount of leakage-compensation current unless an appreciable amount of leakage current is being generated by a circuit producing a drive current. In particular embodiments, the leakage-compensation current may increase exponentially as a function of temperature. Accordingly, a relatively small amount of leakage-compensation current may be generated at lower temperatures (e.g. approximately −40° F. to approximately 100° F.), thus conserving power.

Figure 4:
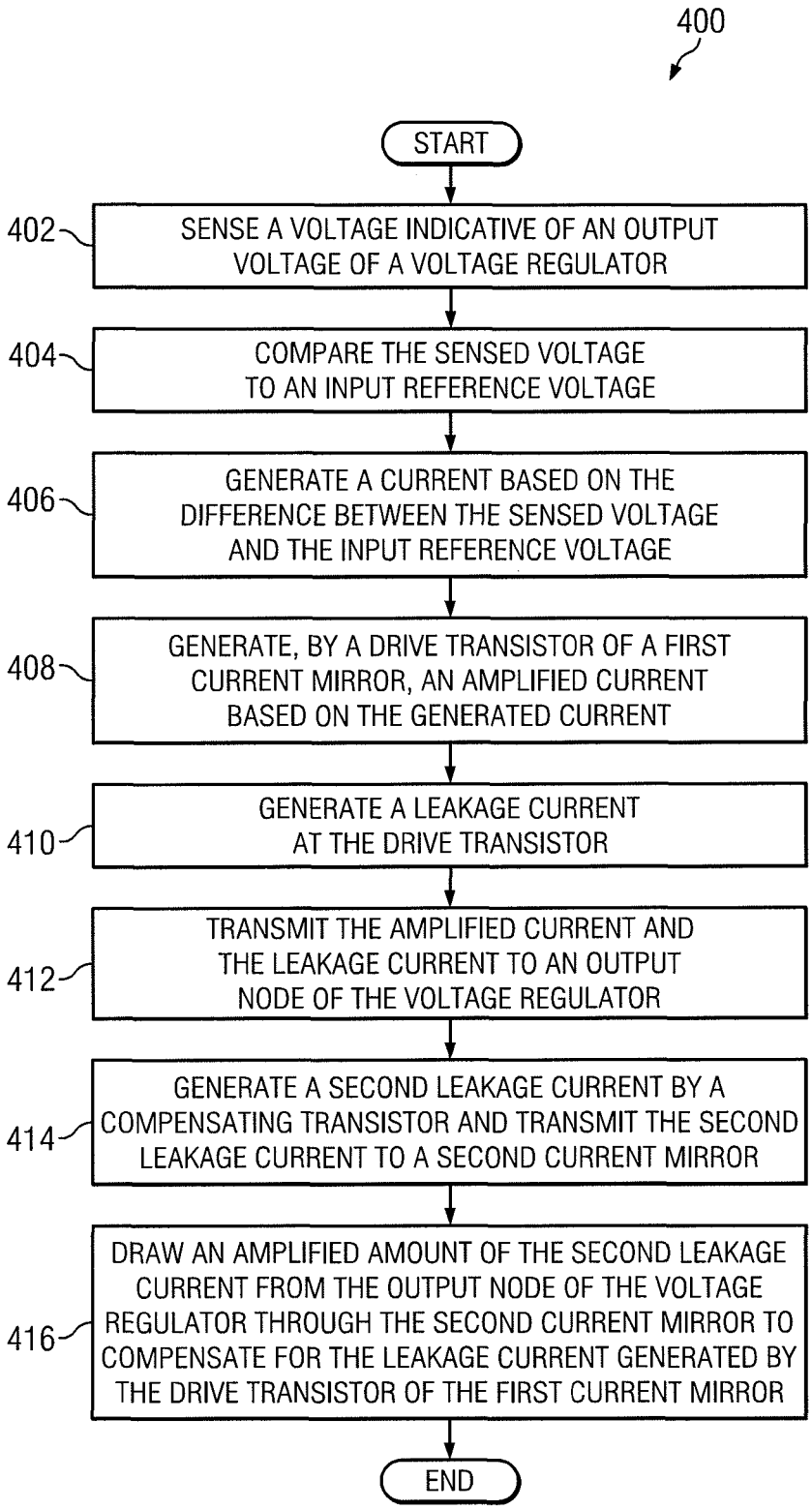
FIG. 4 illustrates an example method for compensating for leakage current in a voltage regulator.

FIG. 4 illustrates an example method 400 for compensating for leakage current in a voltage regulator. The method may start at step 402, where a voltage indicative of an output voltage of a voltage regulator is sensed. In particular embodiments, the sensed voltage may be a fraction of the output voltage of the voltage regulator. For example, the sensed voltage may be a voltage measured at a node that is part of a voltage divider of the output voltage. At step 404, the sensed voltage is compared to an input reference voltage. In particular embodiments, the input reference voltage may be a generally steady reference voltage. In a particular embodiment, the input reference voltage is derived from one or more bandgap voltage references. In such an embodiment, the input reference voltage may be temperature independent. In particular embodiments, the sensed voltage is compared to the input reference voltage by a differential amplifier. At step 406, a current is generated based on the difference between the sensed voltage and the input reference voltage. In particular embodiments, the current may be generated by one or more transistors, such as MOSFETS or BJTs. In particular embodiments, the current may drop as the sensed voltage rises above the input reference voltage and rises as the sensed voltage drops below the input reference voltage.

At step 408, an amplified current is generated by a drive transistor of a first current mirror. In particular embodiments, the amount of amplified current is based on the current generated by the comparison between the sensed voltage and the input reference voltage. In a particular embodiment, the first current mirror comprises the drive transistor and an additional transistor. The drive transistor may be much larger than the additional transistor. In a particular embodiment, the aspect ratio of the drive transistor is at least one hundred times the aspect ratio of the additional transistor of the first current mirror. Accordingly, the size of the amplified current may be much larger than the generated current.

At step 410, the regulating transistor generates a leakage current. The leakage current is generated in addition to the amplified current and may be generated concurrently with the amplified current. The amount of leakage current may be based on many factors, such as temperature, the size of the drive transistor, and one or more voltages applied to the drive transistor. At step 412, the amplified current and the leakage current are transmitted to an output node of the voltage regulator. The output node may be a node of the voltage regulator that provides the output voltage of the regulator to one or more other circuits. At step 414, a second leakage current is generated by a compensating transistor. This transistor may be configured to generate a leakage current that is a fraction of the leakage current generated by the regulating transistor. In a particular embodiment, the compensating transistor has an aspect ratio that is equivalent to the aspect ratio of the additional transistor of the first current mirror described in step 408. The compensating transistor may be configured such that it does not generate appreciable leakage current unless it is exposed to a high temperature (e.g., 100° F. or above). The leakage current generated by the compensating transistor is transmitted to a second current mirror.

At step 416, the second current mirror draws an amplified amount of the second leakage current from the output node of the voltage regulator, at which point the method may end. In particular embodiments, the amplified amount of the second leakage current is approximately equal to the amount of leakage current generated by the drive transistor. As the amplified amount of the second leakage current is drawn from the output node, it compensates for the leakage current from the drive transistor that is transmitted to the output node, thus allowing the voltage regulator to function as if there were little or no leakage current.

Although this disclosure describes and illustrates particular steps of the method of FIG. 4 as occurring in a particular order, this disclosure contemplates any suitable steps of the method of FIG. 4 occurring in any suitable order. Moreover, although this disclosure describes and illustrates particular illustrates particular components carrying out particular steps of the method of FIG. 4, this disclosure contemplates any suitable combination of any suitable components carrying out any suitable steps of the method of FIG. 4.

Herein, reference to a computer-readable storage medium encompasses one or more non-transitory, tangible computer-readable storage media possessing structure. As an example and not by way of limitation, a computer-readable storage medium may include a semiconductor-based or other IC (such, as for example, a field-programmable gate array (FPGA) or an ASIC), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, or another suitable computer-readable storage medium or a combination of two or more of these, where appropriate. Herein, reference to a computer-readable storage medium excludes any medium that is not eligible for patent protection under 35 U.S.C. §101. Herein, reference to a computer-readable storage medium excludes transitory forms of signal transmission (such as a propagating electrical or electromagnetic signal per se) to the extent that they are not eligible for patent protection under 35 U.S.C. §101. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

What is claimed is:

1. A circuit comprising:

a first transistor coupled to a first node, the first transistor configured to generate a drive current, generation of the drive current resulting in a first leakage current from the first transistor, the drive current and the first leakage current each flowing when generated into the first node; and a first leakage-current compensation circuit coupled to the first node and comprising:

a second transistor configured to generate a second leakage current; and a first current mirror comprising a third transistor and a fourth transistor, the first current mirror configured to receive and amplify the second leakage current to generate a leakage-compensation current, the leakage-compensation current flowing when generated away from the first node and through the fourth transistor of the first current mirror;

wherein the first transistor and a fifth transistor comprise a second current mirror.

2. The circuit of claim 1, wherein an amount of the drive current generated by the first transistor is based on a difference between a reference voltage and a fraction of a voltage at the first node.

3. The circuit of claim 1, wherein:

the second transistor comprises a p-type metal oxide semiconductor field-effect transistor (MOSFET);

a gate and a source of the second transistor are coupled to a supply voltage of the circuit; and a drain of the second transistor is coupled to the first current mirror.

4. The circuit of claim 1, wherein the second current mirror is configured to receive and amplify a current generated by a differential amplifier according to a difference between a reference voltage and a fraction of a voltage at the first node.

5. The circuit of claim 4, wherein an aspect ratio of the second transistor is approximately equal to an aspect ratio of the fifth transistor.

6. The circuit of claim 5, wherein an aspect ratio of the fourth transistor divided by an aspect ratio of the third transistor is approximately equal to an aspect ratio of the first transistor divided by the aspect ratio of the fifth transistor.

7. A method comprising:

generating, by a first transistor coupled to a first node, a drive current, generation of the drive current resulting in a first leakage current from the first transistor, the drive current and first leakage current each flowing into the first node;

generating, by a second transistor in a leakage-current compensation circuit coupled to the first node, a second leakage current; and amplifying, by a first current mirror in the leakage-current compensation circuit, the second leakage current to generate a leakage-compensation current, the leakage-compensation current flowing away from the first node, the leakage-current compensation circuit comprising a third transistor and a fourth transistor, the first transistor and a fifth transistor comprising a second current mirror.

8. The method of claim 7, wherein an amount of the drive current is based on a difference between a reference voltage and a fraction of a voltage at the first node.

9. The method of claim 7, wherein:

the second transistor comprises a p-type metal oxide semiconductor field-effect transistor (MOSFET);

a gate and a source of the second transistor are coupled to a supply voltage; and a drain of the second transistor is coupled to the first current mirror.

10. The method of claim 7, further comprising the second current mirror amplifying a current generated by a differential amplifier according to a difference between a reference voltage and a fraction of a voltage at the first node.

11. The method of claim 7, wherein an aspect ratio of the second transistor is approximately equal to an aspect ratio of the fifth transistor.

12. The method of claim 11, wherein an aspect ratio of the fourth transistor divided by an aspect ratio of the third transistor is approximately equal to an aspect ratio of the first transistor divided by the aspect ratio of the fifth transistor.

13. A transceiver comprising:

a circuit comprising:

a first transistor coupled to a first node, the first transistor configured to generate a drive current, generation of the drive current resulting in a first leakage current from the first transistor, the drive current and the first leakage current each flowing when generated into the first node; and a leakage-current compensation circuit coupled to the first node and comprising:

a second transistor configured to generate a second leakage current; and a first current mirror comprising a third transistor and a fourth transistor, the first current mirror configured to receive and amplify the second leakage current to generate a leakage-compensation current, the leakage-compensation current flowing when generated away from the first node and through the fourth transistor of the first current mirror;

a transmitter configured to use at least a first portion of the drive current while transmitting data; and a receiver configured to use at least a second portion of the drive current while receiving data;

wherein the first transistor and a fifth transistor comprise a second current mirror.

14. The transceiver of claim 13, wherein the transmitter and receiver are coupled to a local interconnect network (LIN).

15. The transceiver of claim 13, wherein the transmitter and receiver are coupled to a local interconnect network (LIN) of an automobile.

16. The transceiver of claim 13, wherein an amount of drive current generated by the first transistor is based on a difference between a reference voltage and a fraction of a voltage at the first node.

17. The transceiver of claim 13, wherein:

the second transistor comprises a p-type metal oxide semiconductor field-effect transistor (MOSFET);

a gate and a source of the second transistor are coupled to a supply voltage of the circuit; and a drain of the second transistor is coupled to the first current mirror.

* * * * *